United States Patent [19]

Finsterwalder et al.

[11] 4,295,399

[45] Oct. 20, 1981

[54] APPARATUS FOR INTERMITTENT FEEDING OF WEB-TYPE OR STRIP-TYPE MATERIAL

[75] Inventors: Kurt Finsterwalder; Karl-Heinz Philipp, both of Göppingen; Günter Riedisser, Eislingen; Wilfried Voss, Göppingen, all of Fed. Rep. of Germany

[73] Assignee: L. Schuler GmbH, Goeppingen, Fed. Rep. of Germany

[21] Appl. No.: 949,232

[22] Filed: Oct. 6, 1978

[30] Foreign Application Priority Data

Oct. 6, 1977 [DE] Fed. Rep. of Germany ..... 2744960

[51] Int. Cl.[3] ..... B26D 5/22

[52] U.S. Cl. ..... 83/251; 83/548; 83/734; 83/57

[58] Field of Search ..... 83/57, 202, 204, 221, 83/222, 251, 252, 272, 273, 274, 283, 548, 734; 226/152, 156

[56] References Cited

U.S. PATENT DOCUMENTS

| | | | |
|---|---|---|---|
| 3,192,812 | 7/1965 | Coesens | 83/251 X |
| 3,695,133 | 10/1972 | Finke | 83/222 X |
| 3,782,618 | 1/1974 | Voorhees | 226/155 |
| 4,024,747 | 5/1977 | Bergmann et al. | 113/116 Y |
| 4,138,913 | 2/1979 | Gentile | 83/202 X |

*Primary Examiner*—Frank T. Yost
*Assistant Examiner*—Robert P. Olszewski
*Attorney, Agent, or Firm*—Craig and Antonelli

[57] ABSTRACT

An apparatus for the intermittent feeding of web-type or strip-type material by means of feed roll into an operating chamber of a press. The feed rolls are driven by a main press drive through a mechanical connection and a feed gear mechanism. A scrap cutter is provided which can be driven in correspondence with the operating cycle of the press. The mechanical connection can be selectively severed or interrupted with an auxiliary drive mechanism being provided which is adapted to be connected to the apparatus. The scrap cutter may be driven by a separate drive mechanism in correspondence with the cycle of the feed gear mechanism.

6 Claims, 3 Drawing Figures

APPARATUS FOR INTERMITTENT FEEDING OF WEB-TYPE OR STRIP-TYPE MATERIAL

The present invention relates to a feeding arrangement and, more particularly, to an apparatus for intermittent feeding of web-type or strip-type material by means of feed rolls into an operating chamber of a press with the feed rolls being driven by a main press drive through a mechanical connection such as, for example, a kingpin, and a feed gear mechanism and with the apparatus being preferably provided with a roll release means and a scrap cutter which can be driven in correspondence with an operating cycle of the press.

A feeding apparatus of the aforementioned type is disclosed, for example, in U.S. Pat. No. 4,024,747 and Offenlegungsschrift No. 2,538,239, wherein strip material is intermittently feed into a cutting press which is utilized to, for example, punch out round blanks for electric motor lamellae. The material remaining in the web or strip type material after the blanks are punched out from a grid with such remaining material being subsequently comminuted by means of a scrap shear or the like arranged downstream of the press with the so processed scrap material then being conveyed to a scrap collector. The beginning and end sections, for example, of the strip or web type material to be processed are, in most cases, of inferior quality, and, in conventional systems, the end sections are manually removed from the press. This removal of the sections results in the process being somewhat time consuming and also results in a yielding of pieces of scrap which may be difficult to handle.

The aim underlying the present invention essentially resides in providing an intermittent feeding apparatus for web-type or strip-type material wherein scrap pieces of the material to be processed may be cut into scrap strips which can be easily handled without having to remove the material from the press.

According to advantageous features of the present invention, feed rolls are provided which are driven by a main press drive through a mechanical connection and a feed gear mechanism with the mechanical connection being adapted to be selectively severable and with an auxiliary drive mechanism which may be connected to the press system which auxiliary drive mechanism is effective on the feed gear mechanism.

To provide for a control of the drive connection between the feed gear mechanism and the press, in accordance with yet another feature of the present invention, an index-type separating clutch is arranged in the mechanical drive connection.

Moreover, according to the present invention, a safety slip clutch may be interposed between the feed gear mechanism and the auxiliary drive mechanism.

In accordance with a further feature of the present invention, a free-wheel clutch may be arranged in the mechanical drive connection with the clutch being connected in front of a three membered gear mechanism, the middle gear of which is connected to a drive motor of the auxiliary drive mechanism.

According to another feature of the present invention, the roll release means is inseparably connected to the feed gear mechanism with a control device driven by the roll release mechanism, being provided for driving a separate drive means of the scrap cutter.

Accordingly, it is an object of the present invention to provide an apparatus for intermittent feeding of web-type or strip-type material which avoids, by simple means, shortcomings and disadvantages encountered in the prior art. Another object of the present invention resides in providing an apparatus for intermittent feeding of web-type or strip-type material which functions reliably under all operating conditions.

Yet another object of the present invention resides in providing an apparatus for intermittent feeding of web-type or strip-type material which ensures the production of scrap strips which can be easily handled.

A further object of the present invention resides in providing an apparatus for the intermittent feeding of web-type or strip-type material by which it is possible to cut up, without any problems, faulty sections of the material to be processed at the beginning, and, in intermediate zone of the strip of material.

A still further object of the present invention resides in providing an apparatus for intermittent feeding of web-type or strip-type material which permits the processing of scrap pieces of the material without putting into operation a cutting press or the like.

Another object of the present invention resides in providing an apparatus for intermittent feeding of web-type or strip-type material which minimizes, if not avoids, the unnecessary subjecting of tools of a press to damage.

Yet another object of the present invention resides in providing an apparatus for the intermittent feeding of web-type or strip-type material which eliminates the need to manually remove scrap material from the press.

Still further object of the present invention resides in providing an apparatus for the intermittent feeding of web-type or strip-type material which is less cumbersome and less time consuming than prior art constructions.

These and other objects, features and advantages of the present invention will become more apparent from the following description when taken in connection with the accompanying drawings which show, for the purposes of illustration, several embodiments in accordance with the present invention, and wherein.

Figure 1:
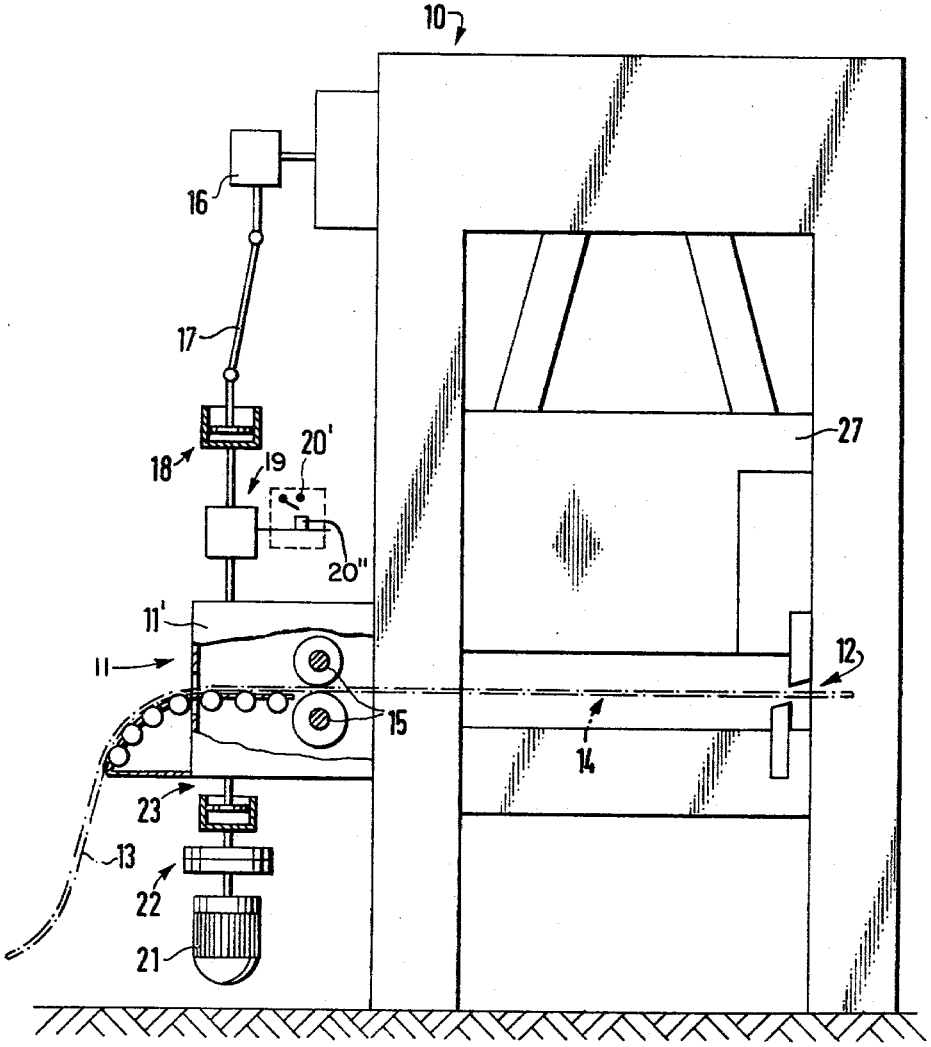
FIG. 1 is a schematic view of a press system having arranged thereat an apparatus for the intermittent feeding of web-type or strip-type material in accordance with the present invention.

Referring now to the drawings wherein like reference numerals are used throughout the various views to designate like parts and, more particularly, to FIG. 1, according to this Figure, a processing system is provided which includes a press generally designated by the reference numeral 10, an intermittent feeding apparatus generally designated by the reference numeral 11 for feeding web-type or strip-type material 13, and a scrap cutter generally designated by the reference numeral 12. The feeding apparatus 11 conveys the strip material 13 into a tool chamber generally designated by the reference numeral 14 of the press 10.

The feed apparatus 11 includes a conventional feed gear mechanism 11' which is operable connected with feed rolls 15. The feed mechanism 11' of the feeding apparatus 11 is driven by a main press drive through a drive connection which includes a miter gear 16, a kingpin 17, an index type separating clutch generally designated by the reference numeral 18 and a conventional roll release means generally designated by the reference numeral 19.

A control device generally designated by the reference numeral 20 is connected to the roll release means 19 with the control device 20 functioning to control the operation of the scrap cutter 12. An auxiliary motor 21 is connected to the feeding apparatus 11 by an electromagnetic clutch generally designated by the reference numeral 22 and a safety slip clutch generally designated by the reference numeral 23. The auxiliary drive motor 21 is operable so as to drive the feed rolls 15 by way of the feed gear mechanism 11'.

Figure 2:
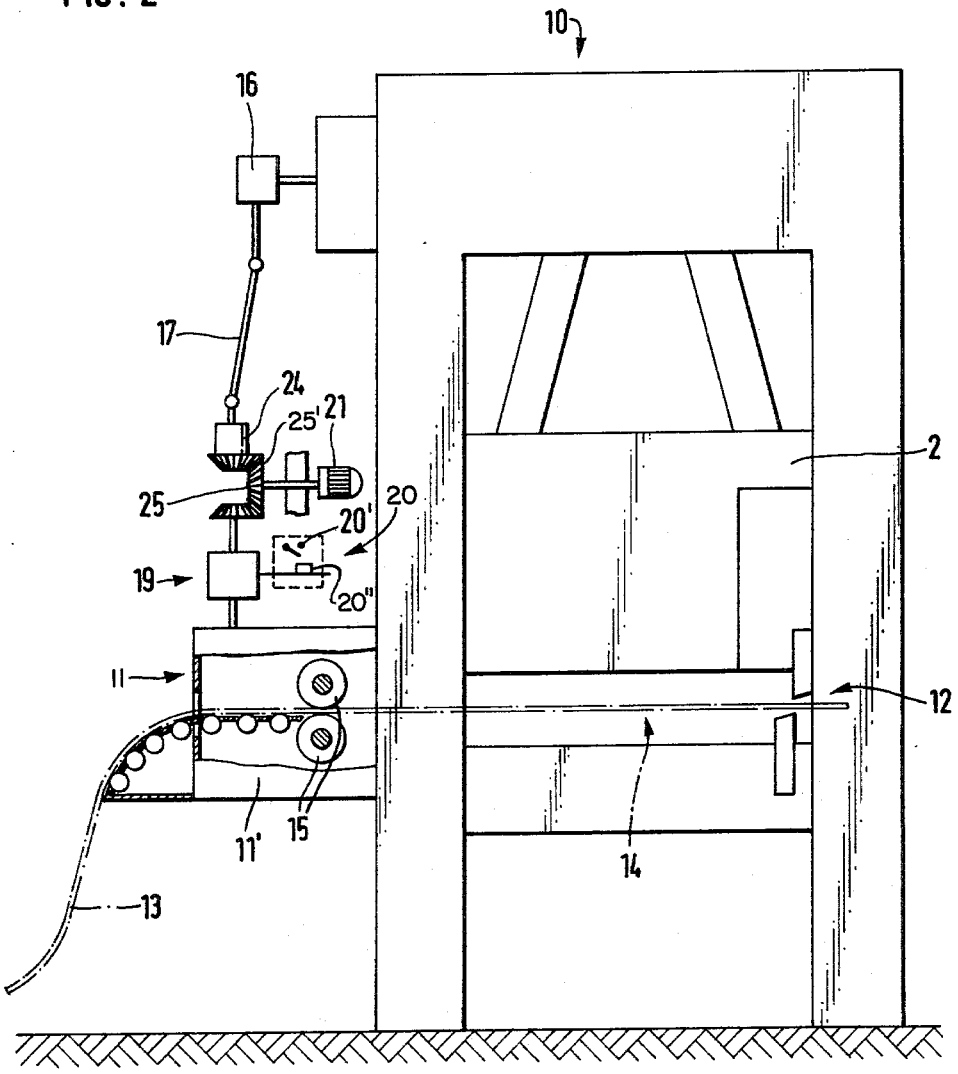
FIG. 2 is a schematic view of a second embodiment of a processing system in accordance with the present invention.

The system of FIG. 2 essentially corresponds to the system of FIG. 1; however, in FIG. 2, the driving connection between the main press drive and the feeding apparatus 11 includes the miter gear 16, the kingpin 17, a free wheel clutch 24, a three membered beveled gear mechanism generally designated by the reference numeral 25, and the roll release means 19. The auxiliary motor 21 is operably connected with the middle bevel gear 25' of the bevel gear mechanism. The auxiliary motor 21 is, for example, fixedly mounted to a frame of the press 10.

Figure 3:
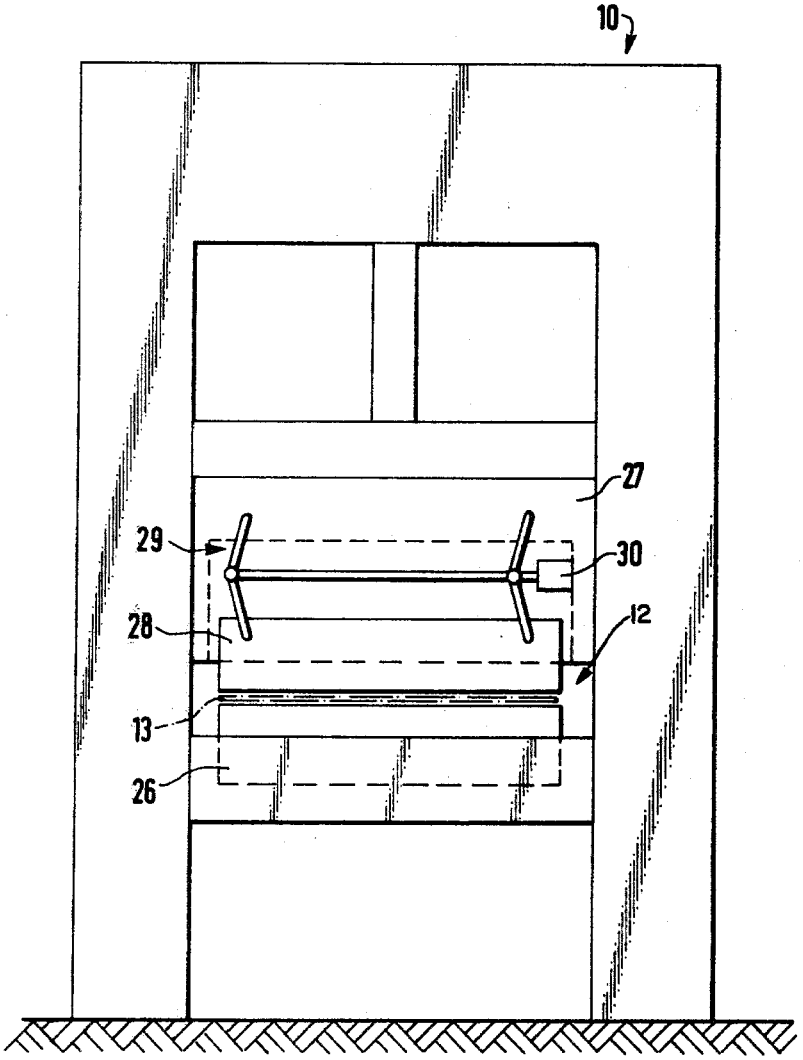
FIG. 3 is an end view of a scrap cutter arranged at an discharge end of the presses illustrated in FIGS. 1 and 2.

As shown in FIG. 3, the scrap cutter 12 is arranged at the material outlet or discharge side of the press 10. The scrap cutter 12 includes a fixed lower blade 26 and an upper plate 28 which is movable with a press ram 27. The upper blade 28 is movable relative to the press ram 27 by means of an articulated drive mechanism generally designated by the reference numeral 29. The articulated drive mechanism is fashioned as a toggle joint drive mechanism with a drive mechanism 30 for the scrap cutter being constructed as a dual-acting cylinder-piston unit. The toggle joint drive mechanism is constructed so as to be selectively lockable whereby, in a locked condition, the upper blade 28 is moved up and down with the press ram 27.

In normal manufacturing operations, the strip material 13 is fed intermittently into the tool chamber 14 of the press 10 by way of the feeding apparatus 11 and the feed rolls 15, with the strip material then being processed in the tool chamber 14. The feed rolls 15 are driven directly by the main press drive through the miter gear 16, kingpin 17, index-type separating clutch 18, roll release means 19, and feed gear mechanism 11' of the feeding apparatus 11.

In operation, the articulated drive mechanism 29 is locked so that the upper blade 28 of the scrap cutter 12 is operated together with the press ram 27 so as to cut up the scrap strip produced from the strip material 13. By means of the roll release means 19, the strip material 13 is released for a short period of time in a conventional manner shortly after a feeding step.

In the construction of FIG. 1, the auxiliary motor 21 is not in operation and is separated from the feeding apparatus 11 by virtue of the electromagnetic clutch 22 being disengaged. If a faulty piece of strip material 13 is present and must be removed, the press ram 27 of the press 10 is brought into an intermediate position between a top dead center and a bottom dead center position and the press ram is then arrested or locked in such position in a conventional manner. The index-type separating clutch 18 is then disengaged and the electromagnetic clutch 22 is activated with the auxiliary motor 21 then being placed in operation. With the press 10 being at a standstill, the strip material 13 continues to be fed stepwise into the tool chamber 14 by means of the feeding apparatus 11.

At the same time, the control device 20, which is in operative connection with the roll release means 19, provides an output control signal so as to control the separate drive 30 of the scrap cutter 12. For this purpose, as schematically illustrated in FIGS. 1 and 2, the control device 20 may include a normally open switch 20' which is adapted to be displaced to a close position by an actuator 20'' coupled to the load release mechanism. As apparent, upon a closing of the switch 20', the control device would provide an appropriate control signal to the drive mechanism 30 by way of suitable lines (not shown).

Upon the drive mechanism 30 being rendered operative, the upper blade 28 of the scrap cutter 12 is actuated by way of the articulated drive mechanism 29 so that faulty strip material 13 is then cut into pieces of scrap in correspondence with the feeding steps.

Once the faulty piece of strip material 13 has been cut up, the separate drive 30 of the scrap cutter 12 is then shut off and the articulated drive mechanism is once again locked. By means of the auxiliary drive mechanism 21, with the feed rollers being lifted, the index-type separating clutch 18, which engages only in predetermined position, is actuated. The engaging process is simultaneously effective on a switching device, (not shown), which functions to shut off the auxiliary drive mechanism 21 and deactivate the electromagnetic clutch 22. If desired, a suitable monitoring or sensoring device (not shown) may be provided for detecting the condition of the auxiliary motor 21 to determine when such motor is at a standstill. For this purpose, the monitoring or sensoring device may sense or monitor the generator operation of the auxiliary motor 21.

The construction of FIG. 2 has a normal operation in the same fashion as that of FIG. 1. The bevel gear mechanism 25 with a free wheel clutch 24 connected in front thereof, is provided in place of the index-type separating clutch 18. In the construction of FIG. 2, the auxiliary drive mechanism 21 acts on the middle bevel gear 25' of the bevel gear mechanism 25 and, in a turned on or operative condition, the drive mechanism 21 drives the feed rolls 15 while the press 10 is at a standstill with the scrap cutter 12 being operated by the separate drive mechanism 30.

After the faulty piece of strip material 13 has been removed from the tool chamber 14, the auxiliary motor 21 rotates the bevel gear mechanism 25 into a predetermined starting position and the motor 21 is then turned off. Normal operation is then resumed with the auxiliary drive mechanism 21 participating in the work cycle without being underload.

In lieu of a bevel gear mechanism 25, it is also possible to utilize other types of gear arrangements which operate in the same manner.

While we have shown and described only one embodiment in accordance with the present invention, it is understood that the same is not limited thereto but is susceptible of numerous changes and modifications as known to one having ordinary skill in the art and we therefore do not wish to be limited to the details shown and described, but intend to cover all such changes and modifications as are encompassed by the scope of the appended claims.

It being understood that feed roll mechanism 11 in combination with roll release means 19 are per se well known in the art e.g. U.S. Pat. Nos. 3,758,011 and 3,782,618.

We claim:

1. An apparatus for intermittently feeding a web-type or strip-type material to an operating chamber of a press having a main press drive means and a scrap cutter means driven in correspondence with an operating cycle of the press, the apparatus including feed roller means, feed gear means operatively connected with the feed roller means, and means for connecting the feed gear means with the main press drive means so that the feed roller means may be driven by said main press drive means, characterized in that means are provided for selectively interrupting the driving of said feed roller means by said main press drive, an auxiliary drive means is operatively connected with the feed gear means so as to drive the same when the drive is interrupted by said interrupting means, and in that a further drive means is operatively connected with the scrap cutter for driving the scrap cutter independently of the main press drive in correspondence with a cycle of the feed gear means.

2. An apparatus according to claim 1, characterized in that said interrupting means includes an index-type separating clutch arranged in the connecting means.

3. An apparatus according to one of claims 1 or 2, characterized in that a safety slip clutch is interposed between the auxiliary drive means and the feed gear means for selectively interconnecting the auxiliary drive means and the feed gear means.

4. An apparatus according to claim 1, characterized in that the connecting means includes three meshing bevel gears arranged such that one of the bevel gears is disposed between the remaining two bevel gears, the interrupting means includes a free wheel clutch means arranged between the main press drive and an input side of the bevel gears, and in that the auxiliary drive means is connected to said one of the bevel gears.

5. An apparatus according to one of claims 1, 2, or 4, characterized in that a roll release means is inseparably connected to the feed gear means, and in that a control means is provided for controlling an operation of said further drive means, said control means is operatively connected with said roll release means so as to be actuated thereby.

6. An apparatus according to claim 5, characterized in that said said connecting means includes a kingpin interposed between the main press drive and the feed gear means.

* * * * *